United States Patent [19]

Brandeau

[11] Patent Number: 4,532,691

[45] Date of Patent: Aug. 6, 1985

[54] WIRE TERMINATION TOOL

[75] Inventor: Edward P. Brandeau, Martinsville, N.J.

[73] Assignee: Thomas & Betts Corporation, Raritan, N.J.

[21] Appl. No.: 447,593

[22] Filed: Dec. 7, 1982

[51] Int. Cl.[3] ..... H01R 43/04

[52] U.S. Cl. ..... 29/566.4; 29/749; 29/751; 29/758

[58] Field of Search ..... 29/861, 866, 749, 750, 29/751, 753, 758, 566.4, 566.3; 339/98, 99 R, 97 R, 97 P

[56] References Cited

U.S. PATENT DOCUMENTS

| | | | |
|---|---|---|---|
| 3,147,058 | 9/1964 | Zdanis | 339/97 R |
| 3,668,301 | 6/1972 | Faulconer | 174/88 R |
| 3,866,294 | 2/1975 | McCaughey | 29/566.4 |
| 3,872,236 | 3/1975 | Swengel, Sr. et al. | 174/68.5 |
| 3,997,956 | 12/1976 | McKee | 29/749 X |
| 4,129,349 | 12/1978 | Von Roesgen | 339/17 |
| 4,168,873 | 9/1979 | Luna | 339/97 R |
| 4,173,388 | 11/1979 | Brandeau | 339/276 |
| 4,412,374 | 11/1983 | Forberg et al. | 29/751 X |

FOREIGN PATENT DOCUMENTS

| | | | |
|---|---|---|---|
| 2437399 | 2/1976 | Fed. Rep. of Germany | 339/97 R |

OTHER PUBLICATIONS

Electronic Connector Study Group Inc., Fourteenth Annual Connectors and Interconnections Symposium Proceedings, "Quick Connect-A Circuit Pack Bread boarding Technique"-Lubowe and Wu, pp. 187-198, Nov. 11-12, 1981.

Electronic Connector Study Group Inc., Fourteenth Annual Connectors and Interconnections Symposium Proceedings, "Quick Connect-A Point-to-Point Wiring System", Fleming, pp. 199-202, Nov. 11-12, 1981.

*Primary Examiner*—Carl E. Hall

*Attorney, Agent, or Firm*—Robert M. Rodrick; Salvatore J. Abbruzzese

[57] ABSTRACT

A tool for making interconnections between electrical wires and a conductive terminal having wire receiving slots therein in a point-to-point wiring system includes an indexing member for locating and registering wires relative to the slots and a pushing element for engaging such wires and entering the slots to fully insert the wires therein. The indexing member, inclusive of a slotted sleeve axially movable, but rotatively fixed, relative to the pushing element, holds wires for ready alignment with the slots. The pushing element defines a plurality of curved splines at the tip thereof for progressively driving the aligned wires deeper into the center of the terminals than at the peripheries thereof.

9 Claims, 11 Drawing Figures

WIRE TERMINATION TOOL

FIELD OF THE INVENTION

This invention relates to a tool for making wiring interconnections in an electric wire termination system and assembly.

BACKGROUND OF THE INVENTION

There are several known ways for discrete point-to-point wiring of components on printed circuit boards, backpanels or the like. By far the most common is the wire-wrap system. In this approach, a terminal, including either a socket or input/output (I/O) pin and a post, is fitted into a printed circuit board to form wiring points with the post projecting therefrom. An insulated wire is cut to length and each wire end is stripped of insulation exposing the conductor which is then wrapped around the terminal post. More than one level of wires may be wrapped on an individual post. Not only does this technique require considerable time for wrapping, unwrapping or modifying, but the three and four level wraps often require complicated programming and planning. Moreover, in the upper levels of a multi-wire-wrap termination, a problem in electrical impedance matching is encountered at short pulse rise times because of the physical distance the wires are located above the wiring board.

An alternative to the wire-wrap system which is intended as an improvement in providing greater economy of making connections on a wiring board is the "quick-connect" system which utilizes an insulation displacement technique. In this approach, a wire terminal including a socket or pin on one end and an insulation displacing contact portion on the other end, is mounted in a circuit board. The contact portion typically includes a pair of tines spaced by a slot for receiving an insulated wire. Interconnections are made by pushing the insulated wire into the slot such that the insulation is displaced and intimate contact is made directly with the wire conductor. More than one wire may be inserted into each slot and such a terminal may be utilized for both input and output purposes. Such insulation displacement terminals and interconnections are more fully described in two articles published by the Electronic Connector Study Group Inc. at the Fourteenth Annual Connectors and Interconnections Symposium Proceedings, Nov. 11 and 12, 1981, one article by Anthony G. Lubowe and C. Phillip Wu, Bell Telephone Laboratories, Inc., entitled "Quick Connect—A Circuit Pack Breadboarding Technique", pages 187–198, and the other by Don Fleming, Robinson Nugent, Inc., entitled "Quick Connect—A Point-To-Point Wiring System", pages 199–206.

One problem with the above insulation displacement approach is in the integrity of the electrical and mechanical connection, in particular with small diameter wires in the range of 30 gauge or finer. The contact tines are typically thin, of thickness about the diameter of the wire and, as such, the bearing surface on a wire is relatively small, resulting in the wire being insufficiently held for high contact reliability or mechanical strength. With such a relatively thin contact structure the insertion of the wire into the slot between the tines is typically accomplished by pushing forces externally of the slot, tending to result in uneven and non-uniform wire insertions. Moreover, sophisticated terminal location equipment employing laser and other optical sensing systems are used to align the wires to be terminated with the terminals in the wiring boards.

Despite the new connection approaches, the wire-wrap system, even with its shortcomings, is still the standard of reliability by which other systems, especially mechanically crimped ones, are presently measured. As such, it is necessary to equal or exceed the electrical and mechanical reliability of wire wrap joints for a different termination system to be acceptable to the performance driven portions of the computer and telecommunication industries. These industries, spurred by the revolution in semiconductor technology and the development of very large scale integrated (VLSI) circuits, have great need for a discrete wiring system which at the same time offers high reliability, improved electrical impedance matching for the high speed signal pulses to and from VLSI circuits, much higher density of wiring, greater system versatility, and, of course, cost effectiveness.

Those who have worked in the art of terminating fine wires, especially fine insulated wires in ranges from 30 gauge (10 mil copper) down to 42 gauge (2.5 mil copper) appreciate the problems involved in making reliable, low-cost terminations which literally billions of joints are involved. Among these problems are the low strength and small size of the wire (in some cases finer than human hair), the difficulty of maintaining dimensional control of very small contacts and, of course, precise control of the steps in terminating the wire. A highly reliable method of terminating fine insulated wire is desirably independent of manufacturing and of human variables. In other words, the wiring system should be inherently self-compensating for minor dimensional differences of wire and contact, for reasonable variations in applicator tooling, for differences in operator skill, and, most importantly, in the initial alignment of wire to contact. The present invention is intended to fill the tooling need for use in an improved wiring system.

SUMMARY OF THE INVENTION

It is therefore a primary object of the invention to provide an improved tool for making electrical interconnection between an electrical wire and a terminal.

It is another object of the present invention to provide a wire termination tool useful in making interconnections of fine wires to terminals without damaging same during termination.

In accordance with the apparatus of the invention for making such wiring interconnections, means are included for placing the wire in registry with a slot in the wire terminal. Also provided is means for engaging the wire that is in registry with the slot and for entering the slot to insert the wire fully therein. In the preferred arrangement, the wire interconnection apparatus includes a support and a wire insertion head on the support, the head having a pushing element at one end of an elongate shaft for engaging and urging the wire into the slot. The wire insertion head, in preferred form, includes a sleeve adjacent the pushing element, the sleeve having a plurality of circumferentially spaced axially extending slots for receiving one or more wires therein. The sleeve is spring biased for axial movement relative to the pushing element. The sleeve is adapted to hold wires within its slots and to fit onto electrical terminals for indexing such wires relative to the terminal slots. The pushing element includes a generally curved surface defining an apex and has a plurality of axially extending splines intersecting each other at the apex. Such splines are configured to enter a similar plurality of correspondingly shaped slots in the terminal for multiple independent wire terminations.

DETAILED DESCRIPTION OF THE PREFERRED EMBODIMENTS

Figure 1:
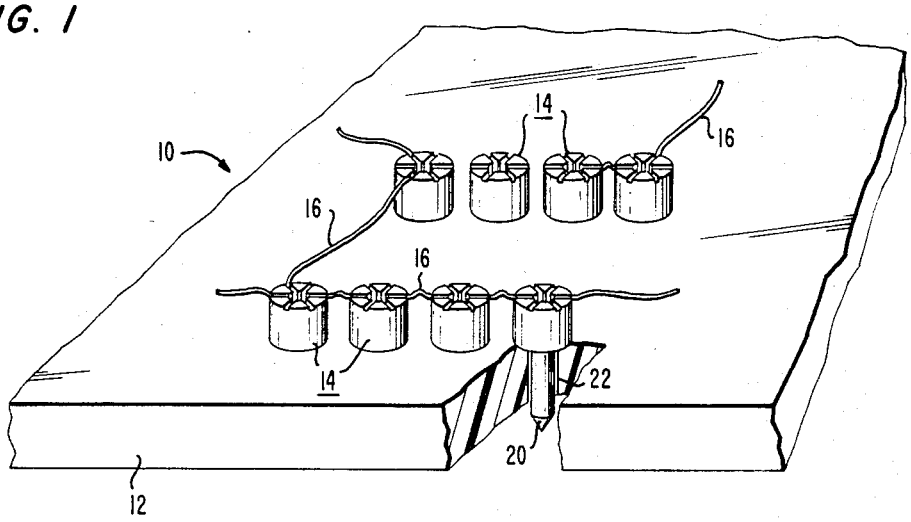
FIG. 1 is a perspective view of a wire termination system made with a tool of the present invention, with an insulative board being shown as fragmented and partly broken away to show details thereof.

Referring now to the drawings, there is shown in FIG. 1 a point-to-point, high density wire termination system 10, formed with tooling of the present invention, including an insulative wiring board 12, a plurality of wire terminals 14 and a plurality of wires 16 electrically interconnecting such terminals 14 in a desired pattern. The board 12 may be a fiberglass reinforced plastic or other insulative substrate commonly used in printed circuit boards, backpanels or the like. The board 12 may have suitable conductive traces (not shown) thereon to provide desired component interconnections. Wires 16 are insulated wires, for example, of 30 gauge solid copper conductor but may be of 32 gauge or finer (i.e., smaller diameter). Wires of 26 and 28 gauge (i.e., larger diameter) are also contemplated. Similarly, although insulated wire is used in the termination system, non-insulated wires may also be terminated in accordance with the present invention, as set forth in more detail hereinbelow.

Figure 2:
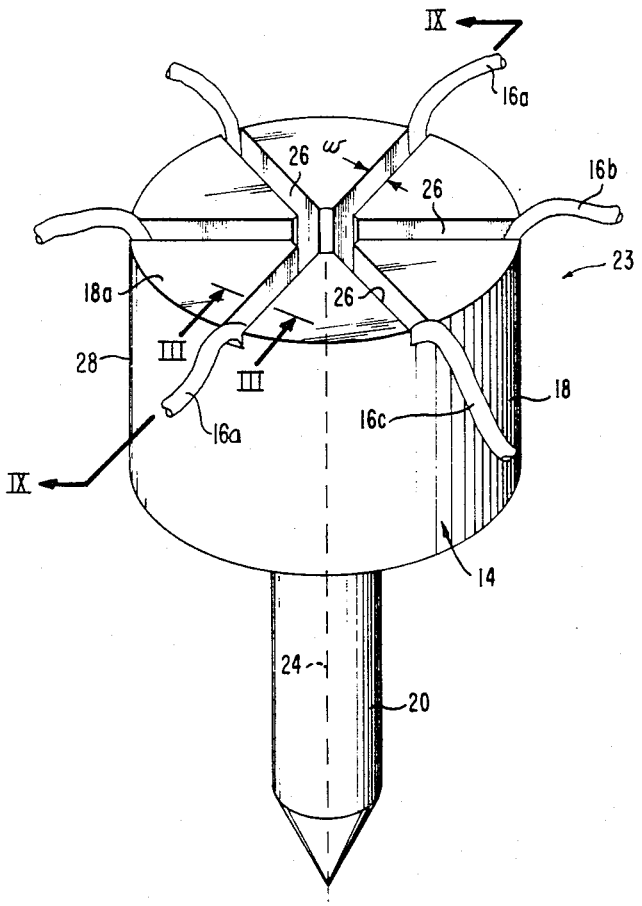
FIG. 2 is an enlarged perspective view of a wire termination assembly from the system of FIG. 1.
Figure 3:
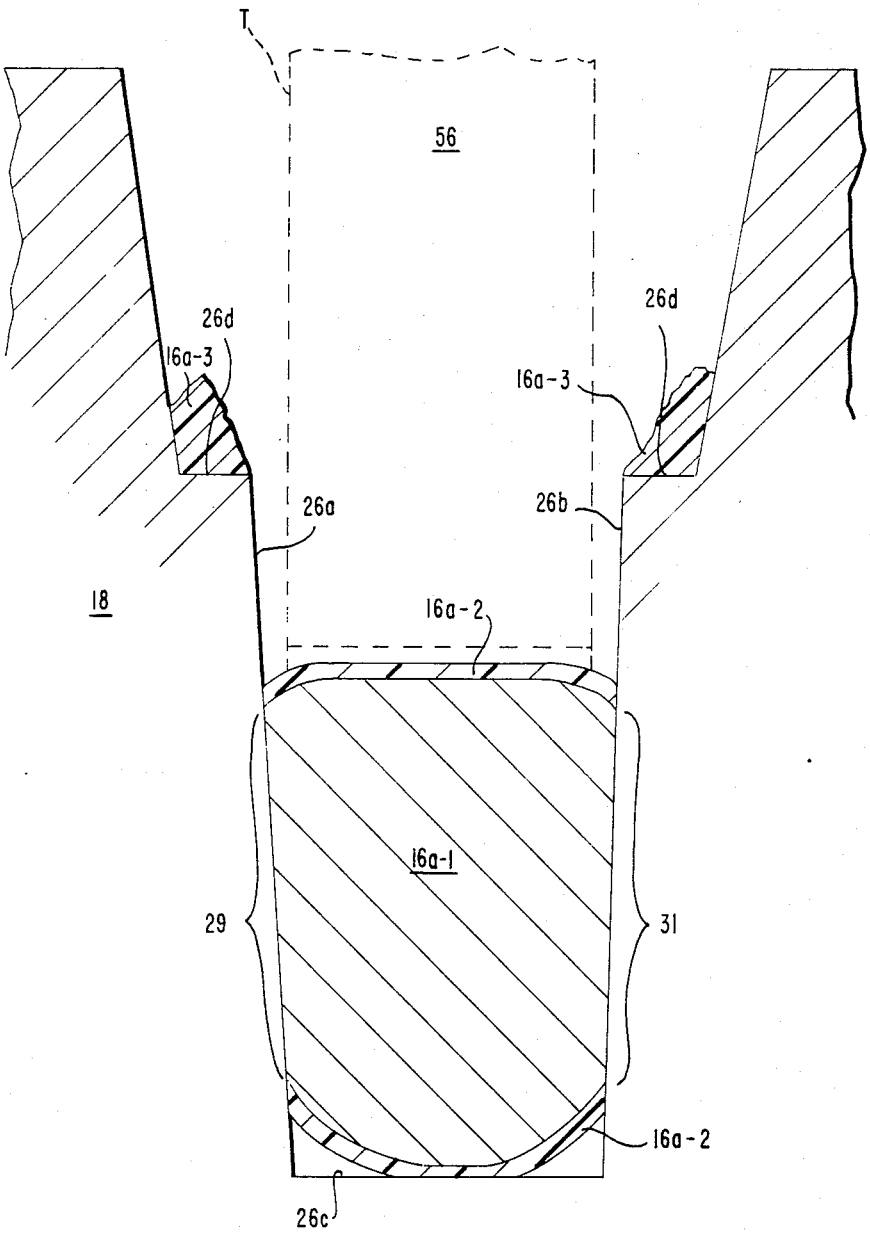
FIG. 3 is a sectional view of FIG. 2 as seen along viewing lines III—III thereof and showing, in phantom, a pushing element of the wire termination tool.

The terminals 14 as seen also in FIGS. 2 and 3 each include an upper cylindrical body 18 having a wire-receiving slotted face **18*a* and a lower integral pin 20 extending axially from the body 18. The pin 20 may be press-fit into an aperture 22 extending through board 12 or may be suitably soldered to conductive traces on the board. Body 18 may also be directly soldered to the board traces without any pin or post portion. Although a solid pin 20 is illustrated, the terminal 14** may also have other termination configurations such as, for example, a socket for receiving component leads.

Referring to FIG. 2, a wire termination assembly 23 includes three insulated wires **16*a*, 16*b* and 16*c* that are terminated in terminal 14. It should be appreciated that the assembly may also include fewer than three wires (six wire ends). In the upper face 18*a* of the cylindrical body 18, which face 18 is substantially orthogonal to the longitudinally extending central axis 24 of the body 18, there are a plurality of radially extending slots 26 formed through the surface 18*a* and into the interior of the body 18. The slots 26 extend into the body along a plane generally parallel with the central axis 24. The slots 26 each preferably extend diametrically across the body 18 through the axis 24 and out through the periphery or outer edge 28 of the body 18. The slots 26 may, however, begin and end at a location interiorly of the periphery 28 without emerging therethrough. The slots 26, as illustrated, intersect at the central portion of the body, are approximately equally spaced angularly thereabout, and have approximately equal widths w (FIG. 2**).

Figure 9:
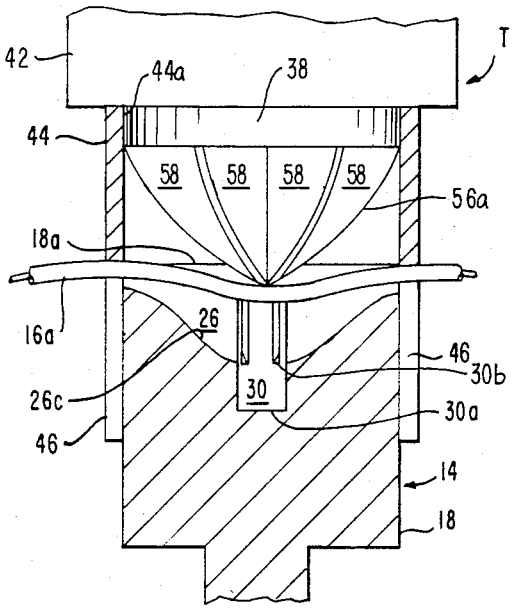
FIG. 9 is a sectional view of the assembly of FIG. 2 as seen along lines IX—IX thereof in a pre-assembled condition and showing an electrical wire located in a terminal slot by the tool pushing element, the wire and tool pushing element not being sectioned for purposes of clarity.

The width w of each slot 26 is formed to receive a wire therein and at some point along its depth to be in interference relation with such wire. The sidewalls **26*a* and 26*b* of the slot, as shown in FIG. 3, may be slightly tapered outwardly and upwardly to present a wedging action to a wire received therein. Each slot 26 has a bottom wall 26*c* that is non-linear, and preferably curved, and that, as seen in FIG. 9, is deeper as measured from upper surface 18*a* at the body central portion than at its periphery 28. The slots 26, as configured, thereby have a non-uniform depth along their lengths. All the slots 26 are formed approximately to a common depth. At the intersection of the slots 26, a recess or well 30 (FIG. 9) is formed, the bottom wall 30*a* of which extends deeper from surface 18*a* than the slot bottom wall 26*c*. Each of the slots 26 communicates with the recess at edges 30*b* (FIG. 9). It will be noted that wire 16*a* as inserted by tool T, as described more fully hereinbelow, has been greatly deformed from its original circular cross-section by the force of pushing it to the bottom of slot 26. Between the bottom wall 26*c* of the slot and the conductor part 16*a*-1 of the wire, a thin layer of insulation 16*a*-2 remains, and a similar thin layer 16*a*-2 lies on the top of the wire. However, the insulation along zones 29 and 31, which also extend perpendicularly to the plane of the drawing for a considerable distance along the slot length has been skived away and virgin surfaces of bare wire are held in gas tight, high force, clean contact with the connector body 18. A pair of steps or sharp shoulders 26*d* are provided in the walls 26*a* and 26*b* of some or all of the slots 26. Insulation residue 16*a*-3 is left on these shoulders as the wire is pushed to the bottom of the slot 26. The terminal 14** as disclosed herein together with the wire termination system and assembly and the interconnection method, are more fully described in copending, commonly-assigned patent applications, Ser. No. 447,591, entitled "Wire Termination System and Terminator Therefor", and Ser. No. 447,592, entitled "Method of Making Wire Terminations", both filed on even date herewith.

Figure 4:
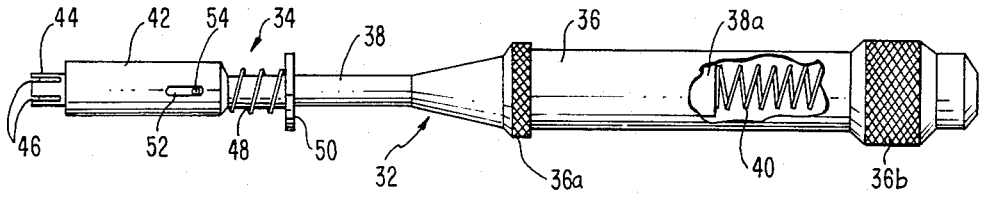
FIG. 4 is a side elevational view of a tool for making wire interconnections in accordance with a particular form of the invention.
Figure 5:
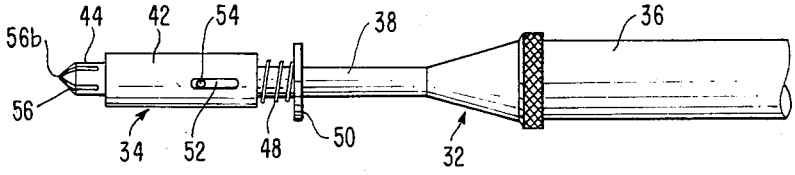
FIGS. 5 and 6 are fragmentary views of the tool of FIG. 4 showing, in FIG. 5, the retraction of the wire indexing sleeve and, in FIG. 6, the movement of the tool head relative to the tool handle.
Figure 6:
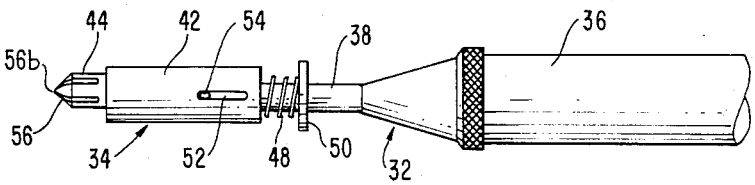

Turning now to FIGS. 4 through 6, a tool 32 is illustrated for use in effecting the wire terminations shown in the assembly 21 and in the system 10. Tool 32, in the embodiment depicted, is a manually operable apparatus of size to be held in the hand of the operator. The tool 32 includes a head section 34 supported by a handle 36 which may have knurled portions 36*a* and 36*b* for gripping enhancement purposes. The head 34, resiliently movable relative to the handle 36, includes an elongate shaft 38 that extends interiorly of the handle 36. The end 38*a* of the shaft 38 within the handle 36 abuts a spring 40 or other biasing member such that upon movement of the shaft 38 interiorly of the handle 36, a resistive force is applied to the shaft 38. A suitable force sensing mechanism (not shown) may be incorporated within the handle in a manner commercially available in the art, to provide a "snap action" to the shaft 38 upon application of a predetermined resistive force thereto, thereby releasing the force thereon and providing substantially uniform application force.

The tool head 34 further includes a hollow sleeve 42 that is movable along the shaft 38. At its free end, the sleeve includes a hollow wire indexing portion or cup 44 having a plurality of circumferentially spaced axially extending slots 46, each adapted, as will be described subsequently, to receive a wire 16 therein. In the embodiment illustrated, six slots 46 are formed through the walls of the cup 44, although more or less may be used. The sleeve 42 is biased to a first position, as shown in FIG. 4, by a spring 48 that is captured on the shaft 38 between the sleeve 42 and an annular flange 50 that is affixed to the shaft 38. The spring constant of spring 48 is much less than that of spring 40 in the handle 36. The sleeve 42 has a slot 52 extending through opposing wall surfaces, the slot 52 being adapted to slidably receive a pin 54 therein, which pin is affixed to the shaft 38. The extent of axial sleeve movement is limited by the length of the slot 52 as it engages the pin 54. The shaft 38 and the sleeve 42 are fixed against relative rotative movement by the pin 54.

As illustrated in FIG. 4, the sleeve 42 is in its normally biased position with the pin 54 engaging the slot 52 at its most rightward portion. In FIG. 5, the sleeve 42 is seen as retracted against the bias of spring 48 with the pin 54 engaging the slot 52 at its most leftward portion. In FIG. 6, in addition to the sleeve 42 being in the retracted position, the head shaft 38 is shown as moved into the handle whereby a force as effected through the spring 40 is transmitted through the shaft to a pushing element 56. In the retracted position, the sleeve 42 exposes the wire pushing element 56 that is defined by the tip of the shaft 38 and which extends axially beyond the sleeve 42 adjacent the cup 44. As seen more in detail in FIG. 9, the wire pushing element 56 includes a generally curved surface 56*a* and a plurality of axially extending vanes or splines 58 that intersect at the apex 56*b* (FIG. 6) of the pushing element curved surface 56*a*. The splines 58 are formed to be of configuration substantially corresponding to but somewhat narrower than the width of the slots 26 in the wire terminal 14 for entering such terminal slots 26 in tool operation, as will be described. The splines 58 have curved bottoms substantially conforming to the bottom curvature of the slots 26. It should be understood that the axial projection of the pushing element 56 exteriorly of the sleeve 42 when the sleeve is retracted is a particular design preference and that resilient axial movement of the pushing element 56 relative to the cup 44 does not require such pushing element exposure.

Figure 7:
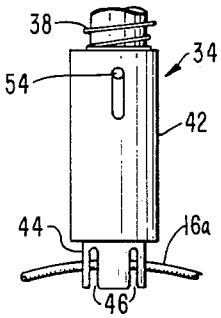
FIGS. 7 and 8 are enlarged top and side elevation views of the front end of the tool of FIG. 4, showing the indexing to an electrical wire.
Figure 8:
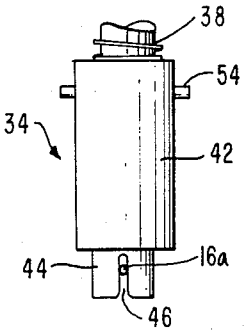

Turning now to FIGS. 7 through 10, the use of the tool 32 in effecting wire interconnections is described. It is important for a wire being terminated to be accurately positioned relative to a slot, otherwise the wire may be broken or guillotined. The top surface 18*a* of a terminal 14 as seen in FIG. 2 may be likened to the face of a clock, with radial slots 26 at 1 o'clock, 3, 5, 7, 9 and 11. Visualizing that a wire is held parallel to face 18*a* and is being brought down to it, it is necessary to laterally align the wire and to angularly (i.e., radially) orient it so that it comes to rest along and properly in the top of a slot 26. As illustrated in FIGS. 7 and 8, a wire to be terminated, for example, wire 16*a*, is first indexed to the tool by placing such wire 16*a* into a pair of diametrically opposed slots 46 in the cup 44, such that wire 16*a* extends substantially across the head of the tool and transversely relative to the longitudinal axis of the shaft 38. In the slots 46, the wire 16*a* is effectively held in a fixed axial position relative to the pushing element 56 for subsequent connection to a terminal 14. The tool, having the wire 16*a* indexed thereto, is then indexed to a conductive wire terminal 14. Indexing the tool to the terminal 14 is achieved as follows.

FIG. 9 shows a cross-section of a terminal 14 with wire 16*a*, the first wire to be terminated lying along the top mouth of a slot 26, for instance, the slot at one and seven o'clock in FIG. 2. Applicator tool T is located laterally relative to terminal body 18 by means of the thin-walled cup 44, the inner diameter 44*a* of which slidably fits over the top and around the circumference of contact body 18. Wire 16*a* is stretched between diametrically opposite slots 46 in cup 44 and is held in the position shown relative to the cup 44 as the tool is vertically indexed on a terminal 14. Lying above wire 16*a* within cup 44 is the pushing element 56 (see also FIG. 3) which is free to slide downwardly, but not rotate, relative to cup 44 when the tool is actuated to crimp wire 16*a* into slot 26. The pushing element 56 is precisely aligned above and along the wire by cup slots 46.

Now, while wire 16*a* is laterally and vertically aligned with respect to terminal 14 by tool cup 44, the radial alignment may not be correct. But this is precisely achieved, once lateral and vertical alignment are present, by lightly pushing down on element 56 and simultaneously or sequentially slightly rotating tool T. During this rotative operation, cup 44 is held approximately in the vertical position shown in FIG. 9 by wire 16*a* which is bottomed in cup slots 46 and which rests on the upper face 18*a* of the terminal. As the tool is rotated whatever slight amount is necessary, wire 16*a* indexed itself and tool splines 58 into precise radial alignment with the slots 26. This positions wire 16*a* as shown in FIG. 9.

Figure 10:
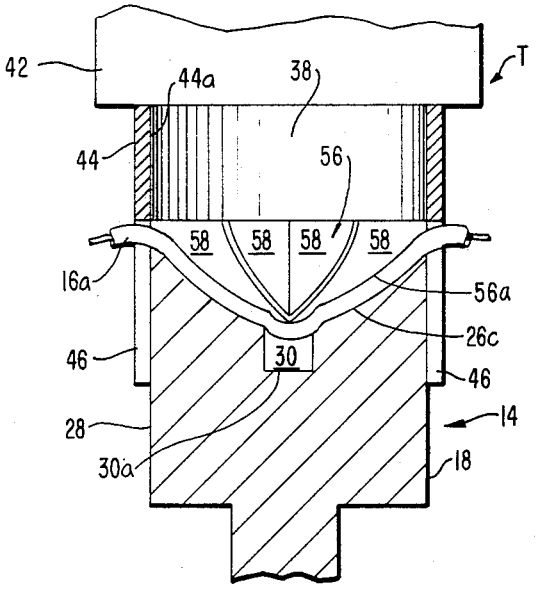
FIG. 10 is a view as in FIG. 9 showing the wire as fully seated in the terminal slot as inserted therein by the tool pushing element.

Cup 44 and pushing element 56 are free to rotate together, with a controlled frictional force. Thus, while wire 16*a* is held against face 18*a* but not indexed in a slot, rotation of the tool T rotates cup 44, and with it wire 16*a* into indexed position relative to a desired slot 26. An increased light, downward force under the bias of spring 48 will now insure that further rotation of the tool in either direction will thereafter not move the wire out of indexed relation to the slot, as the frictional force applied to rotate cup 44 is insufficient to dislodge wire 16*a* from the slot mouth where it is held by pushing element 56, the wire thereby preventing the cup from rotating. Since the pushing element 56, because of the positioning of cup slots 46, is precisely aligned relative to wire 16*a* and with all the slots 26 in terminal 14, the tool shaft 38 may now be moved forcefully downward to push the wire all the way into its respective slot. Application of such a downward force to the tool causes the shaft 38 to enter the handle 36 and apply a force to the pushing element 56 as determined by the bias of the spring 40. Under such force, as shown in FIG. 10, the pushing element 56 transversely engages the wire 16 and, due to their configuration, the splines 58 progressively enter the slots 26 and forcibly drive the wire 16*a* into such slots until fully seated against each slot floor 26*c*. Accordingly, the wire 16*a* lies deeper in the slot 26 at the central portion than at the terminal periphery 28. When the maximum application force is reached near the end of the tool stroke, the force of the spring 40 will be released as manifested by the "snapping action" as described hereinabove giving a sudden, sharp blow to the wire, thereby coining the wire tightly into wedged condition in the slot.

Insertion of the wires with a force applied within the boundaries of the slots provides a uniform force in skiving the insulation from the marginal longitudinal sides of the wire resulting in intimate connection between the exposed conductor and the slot sidewalls, as shown in FIG. 3, with substantially no insulation therebetween. As the splines 58 are somewhat narrower than the slots, the wires are driven to the bottom of the slots with the splines being guided by the slot sidewalls. The wire is thus supported along its length in the slot thereby avoiding tension on the wire which might otherwise easily break it. Also, inasmuch as it is desirable for enhanced connection and wire pull-out purposes to connect the wire to the terminal along a wire length substantially greater than its diameter (for example, seven times greater), use of the slot-entering pushing element is effective in providing a uniform insertion force across such length of connection. By means of the recess 30 in the terminal, a wire crossing relief is provided, which allows all of the wires, for example, 16*a*, 16*b* and 16*c*, to be fully seated on the respective slot floors 26*c*, despite the intersection of these wires as the recess 30 allows the central portions of such wires to be disposed therein during insertion without creating a bulge at the intersection thereof. Moreover, by inserting the wires in different slots that lie along different transverse axes, preferably intersecting, all wires may be inserted to a substantially common depth, except at the cross-over point, to minimize impedance mismatching while, being in independent slots, the insertion of each wire has minimal impact or influence on the connection of the other wires.

Figure 11:
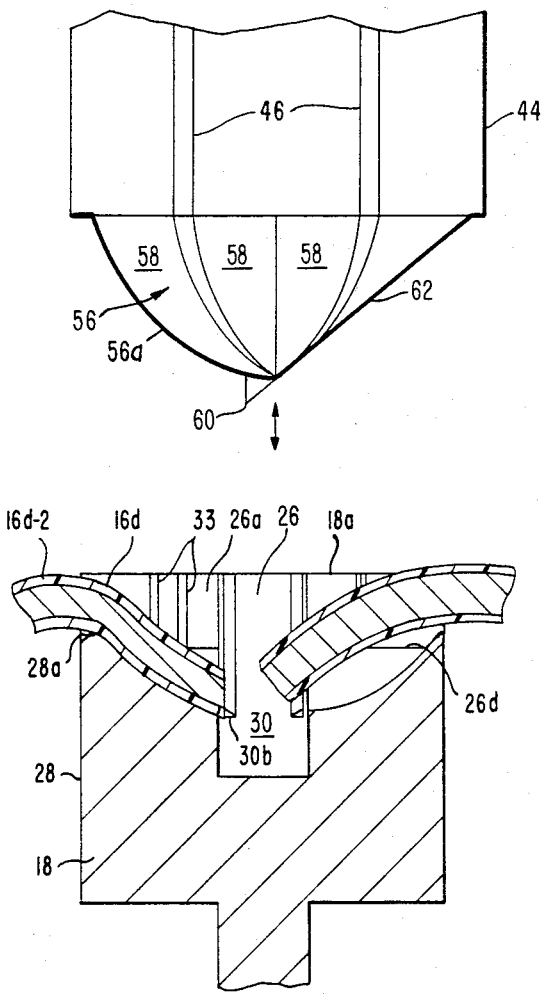
FIG. 11 is an enlarged sectional view similar to FIG. 9 but showing a modified tool pushing element for cutting a wire in the center of a terminal.

Wires 16*a*, 16*b* and 16*c* have been shown with each coming in and going out from body 18 without being cut. This is equivalent to six wire-wrap terminations. As each wire termination in the present assembly is equivalent to two wire-wraps, the reliability is increased thereover. Thus, the wiring system makes it very easy to daisy-chain or series-wire contacts for power distribution, for example. However, it should be appreciated that each wire may easily be cut within the contact body in the vicinity of recess 30. This is accomplished, as shown in FIG. 11, by putting a barb 60 or chisel edge on the tool pushing element 56 which cuts the wire against a slot edge 30*b*, for example. FIG. 11 shows a wire 16*d*, the left-hand portion of which has been stuffed in a slot 26 by a spline 58 and cut at edge 30*b*. As one of the splines 58 aligned with the chisel edge 60 has a recessed surface, shown herein as linear surface 62 which does not extend fully into a slot, the right-hand portion of wire 16*d* has not been stuffed and can easily be removed and discarded. In similar fashion another wire can be stuffed in the right-hand part of the slot without disturbing the already stuffed left-hand wire. Thus, up to six separate wires may be terminated in contact body 18 while maintaining the contact integrity of each wire. Shoulder 26*d* and ribs 33, which may be provided on the terminal slot sidewalls for additional insulation displacement and wire gripping, are also shown in FIG. 11.

Having described the preferred embodiment of a tool for interconnecting electrical wires, it can be seen that such tooling is not only advantageous in high density, point-to-point wire termination systems but also in the formation of simple termination assemblies. Also, while the tool described herein has been shown as a manually operable apparatus, such tool may be suitably arranged to operate automatically or semi-automatically. It should be appreciated that various other modifications may be made without departing from the intended scope of the invention. The particularly disclosed and depicted embodiments of the invention are thus intended in an illustrative rather than limiting sense. The true scope of the invention is set forth in the following claims.

I claim:

1. An apparatus for making an interconnection between an electrical wire and a conductive terminal having a wire receiving slot therein, comprising:

a support;

a wire insertion head on said support and having a pushing element at one end thereof for engaging and urging said wire into said slot, said wire insertion head including an elongate shaft, one end of which is resiliently movably supported by said support and the other end of which defines said pushing element; and a member for indexing said wire to said terminal, said indexing member comprising a sleeve resiliently movable axially relative to said shaft.

2. An apparatus according to claim 1, wherein said sleeve is biased to a first position wherein said pushing element is interior said sleeve and is retractable against said bias to a second position wherein said pushing element extends exteriorly of said sleeve.

3. An apparatus according to claim 1, wherein a portion of said sleeve adjacent said pushing element has a plurality of circumferentially spaced axially extending slots for receiving one or more wires therein.

4. An apparatus according to claim 3, wherein said pushing element has a generally curved surface defining an apex approximately at the central axis of said shaft.

5. An apparatus according to claim 4, wherein said curved surface includes a plurality of axially extending splines intersecting each other at said apex, said splines being disposed for entering a plurality of correspondingly shaped slots extending within said terminal.

6. An apparatus according to claim 1, wherein said support defines a handle for manual operation of said tool.

7. A tool according claim 1, further including means on said pushing element for cutting said electrical wire within said slot.

8. A tool according to claim 7, wherein said cutting means includes a sharp-edged member projecting from a surface of said pushing element.

9. A tool according to claim 7, wherein said pushing element includes on one side of said cutting means a wire engaging surface for engaging a first portion of said wire and driving same into said slot and on the opposite side of said cutting means a recessed surface configured to accommodate a second portion of said wire without driving such second portion into said slot upon movement of said pushing element.

* * * * *